US010173083B2

(12) United States Patent
Townsend

(10) Patent No.: US 10,173,083 B2
(45) Date of Patent: Jan. 8, 2019

(54) LUNG DEMAND VALVE

(71) Applicant: Draeger Safety UK Limited, Blyth, Northumberland (GB)

(72) Inventor: Paul Nicholas Townsend, Cramlington (GB)

(73) Assignee: DRAEGER SAFETY UK LIMITED, Blyth, Northumberland (GB)

( * ) Notice: Subject to any disclaimer, the term of this patent is extended or adjusted under 35 U.S.C. 154(b) by 470 days.

(21) Appl. No.: 14/770,101

(22) PCT Filed: Feb. 14, 2014

(86) PCT No.: PCT/GB2014/050431
§ 371 (c)(1),
(2) Date: Aug. 25, 2015

(87) PCT Pub. No.: WO2014/132033
PCT Pub. Date: Sep. 4, 2014

(65) Prior Publication Data

US 2016/0001106 A1 Jan. 7, 2016

(30) Foreign Application Priority Data

Mar. 1, 2013 (GB) ..... 1303734.6

(51) Int. Cl.
*A62B 9/02* (2006.01)
*A62B 9/00* (2006.01)
(Continued)

(52) U.S. Cl.
CPC ..... *A62B 9/022* (2013.01); *A62B 9/006* (2013.01); *A62B 7/04* (2013.01); *B63C 11/2236* (2013.01)

(58) Field of Classification Search
CPC ..... A62B 9/022; A62B 9/006; A62B 7/04; A62B 9/02; A62B 18/02; A62B 9/04;
(Continued)

(56) References Cited

U.S. PATENT DOCUMENTS 4,207,884 A * 6/1980 Isaacson ..... A61M 16/208 128/200.24
4,275,723 A * 6/1981 Warncke ..... A62B 9/006 116/137 R
(Continued)

FOREIGN PATENT DOCUMENTS

CN 1374136 10/2002
CN 200954322 10/2007
(Continued)

OTHER PUBLICATIONS

Search report dated Jul. 25, 2013, from corresponding GB Application No. 1303734.6.
(Continued)

*Primary Examiner* — Andrew S Lo
(74) *Attorney, Agent, or Firm* — DLA Piper LLP (US)

(57) ABSTRACT

There is disclosed a lung demand valve comprising: a body within which is disposed a diaphragm and a valve assembly having a valve inlet, the valve assembly and diaphragm arranged to cooperate to control the delivery of breathable gas to a user. There is also provided a breathable gas inlet fluidically connected to the valve inlet inside the body and arranged to be fluidically connected to a supply of breathable gas; and a whistle coupled to the body. The whistle has a whistle inlet fluidically connected to the breathable gas inlet inside the body and a whistle outlet disposed outside the body. In use, when the pressure of the breathable gas in the breathable gas inlet is less than a threshold, breathable gas flows from the breathable gas inlet through the whistle
(Continued)

inlet and outlet thereby causing the whistle to sound outside of the body.

19 Claims, 6 Drawing Sheets

(51) Int. Cl.
*A62B 7/04* (2006.01)
*B63C 11/22* (2006.01)

(58) Field of Classification Search
CPC ..... A62B 18/04; A62B 18/10; A62B 7/00; B63C 11/2236; A61M 16/06; A61M 16/0816; A61M 16/0875; A61M 16/20
USPC ..... 128/205.24, 204.26, 201.24, 201.28, 128/204.18, 205.11, 205.25
See application file for complete search history.

(56) References Cited

U.S. PATENT DOCUMENTS 4,437,460 A * 3/1984 Glynn ..... A62B 9/025 128/204.26
4,592,349 A * 6/1986 Bird ..... A61M 16/08 128/204.25
4,898,174 A * 2/1990 Fangrow, Jr. ..... A61M 16/00 128/204.24
5,007,420 A * 4/1991 Bird ..... A61M 16/08 128/200.14
5,862,802 A * 1/1999 Bird ..... A61M 16/00 128/204.18
6,016,802 A * 1/2000 Jackson ..... A62B 9/02 128/201.19
6,619,286 B2 * 9/2003 Patel ..... A62B 9/02 128/201.24
7,174,891 B2 * 2/2007 Lurie ..... A61H 31/005 128/204.23
2012/0260919 A1 * 10/2012 Townsend ..... A62B 9/027 128/204.26

FOREIGN PATENT DOCUMENTS

CN 201379914 1/2010
GB 783565 9/1957

OTHER PUBLICATIONS

International Search Report and Written Opinion from PCT/GB2014/50431.
Notification of the First Office Action dated May 19, 2017, of corresponding Chinese Application No. 2014800116203 in English.

* cited by examiner

LUNG DEMAND VALVE

BACKGROUND

The invention relates to a lung demand valve having a whistle and a method of upgrading a lung demand valve by attaching a whistle to a lung demand valve.

A lung demand valve (LDV) is typically used with breathing apparatus in order to control the delivery of breathable gas from a source of breathable gas, such as a gas cylinder, to a user operating in a hazardous environment. An LDV typically comprises a flexible diaphragm that responds to pressure changes associated with inhalation or expiration by a user, so as to open and close a valve and thereby control the flow of breathable gas. A first side of the diaphragm is exposed to ambient pressure and the second side of the diaphragm is exposed to the pressure within the facemask.

During use of the breathing apparatus, the amount of breathable gas may diminish, and therefore the pressure of the breathable gas may reduce. A low pressure may indicate that the source of breathable gas is running out. Accordingly, it is important for users of breathing apparatus to monitor the pressure of the source of breathable gas so that they can evacuate the hazardous environment before the source of breathable gas completely runs out.

It is known to provide self-contained breathing apparatus with a pressure gauge having a warning device that generates an audible or visual alarm when the pressure of the source of breathable gas drops below a minimum. In other arrangements the pressure of the source of breathable gas may be remotely monitored and warnings may be provided by radio communication with a banksman or an operator monitoring the gas supply.

Whilst these known warning arrangements may be satisfactory in some circumstances, users may fail to notice when their warning device has been activated, or may fail to realise that a warning relates to their equipment and not that of another person operating in the same hazardous environment. This may be especially problematic in noisy and/or dirty environments.

It is therefore desirable to provide an improved warning arrangement for use with breathing apparatus.

SUMMARY OF THE INVENTION

An exemplary embodiment of the present invention comprises a lung demand valve that comprises body within which is disposed a diaphragm and a valve assembly having a valve inlet, the valve assembly and diaphragm arranged to cooperate to control the delivery of breathable gas to a user; a breathable gas inlet fluidically connected to the valve inlet inside the body and arranged to be fluidically connected to a supply of breathable gas; a whistle coupled to the body and extending from the inside to the outside of the body, the whistle having a whistle inlet disposed within the body and fluidically connected to the breathable gas inlet inside the body, and a whistle outlet disposed outside the body; and a manifold disposed within the body and having at least three ports, wherein each port is fluidically connected to one of the valve inlet, breathable gas inlet and whistle inlet wherein in use, when the pressure of the breathable gas in the breathable gas inlet is less than a threshold, breathable gas flows from the breathable gas inlet through the whistle inlet and outlet, thereby causing the whistle to sound outside of the body.

Another exemplary embodiment of the present invention comprises a lung demand valve that comprises a body within which is disposed a diaphragm and a valve assembly having a valve inlet, the valve assembly and diaphragm arranged to cooperate to control the delivery of breathable gas to a user; a breathable gas inlet fluidically connected to the valve inlet inside the body and arranged to be fluidically connected to a supply of breathable gas; and a whistle coupled to the body and having a whistle inlet fluidically connected to the breathable gas inlet inside the body and a whistle outlet disposed outside the body; wherein in use, when the pressure of the breathable gas in the breathable gas inlet is less than a threshold, breathable gas flows from the breathable gas inlet through the whistle inlet and outlet, thereby causing the whistle to sound outside of the body.

BRIEF DESCRIPTION OF THE DRAWINGS

Embodiments of the invention will now be described, by way of example, with reference to the accompanying drawings, in which.

DETAILED DESCRIPTION

Figure 1:
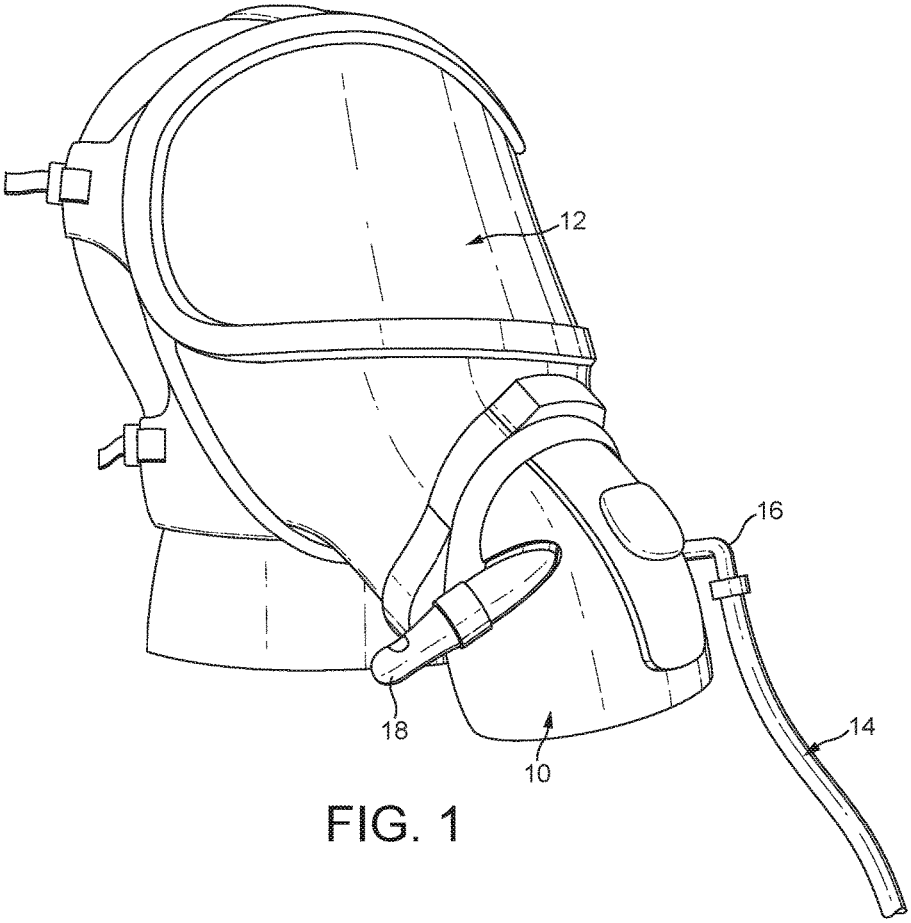
FIG. 1 shows a perspective view of a facemask breathing apparatus provided with a lung demand valve having an integrated whistle.

According to an aspect of the invention, there is provided a lung demand valve comprising a body or housing within which is disposed a diaphragm and a valve assembly having a valve inlet, the valve assembly and diaphragm arranged to cooperate to control the delivery of breathable gas to a user; a breathable gas inlet fluidically connected to the valve inlet inside the body and arranged to be fluidically connected to a supply of breathable gas; and a whistle coupled to the body and having a whistle inlet fluidically connected to the breathable gas inlet inside the body and a whistle outlet disposed outside the body; wherein in use, when the pressure of the breathable gas in the breathable gas inlet is less than a threshold, breathable gas flows from the breathable gas inlet through the whistle inlet and outlet, thereby causing the whistle to sound outside of the body. When the pressure of the breathable gas drops below a predefined level, the whistle sounds close to the user's ear providing an audible warning.

The whistle may extend from the inside to the outside of the body. The whistle inlet may be directly fluidically connected to the breathable gas inlet upstream of the valve inlet. The whistle inlet may be disposed within the body. This may mean there is a direct unobstructed fluid path between the whistle inlet and the breathable gas inlet such that the gas pressure of the whistle inlet is the same as that at the breathable gas inlet. The whistle may be integrated into the LDV.

The breathable gas inlet may extend from the outside to the inside of the body. The breathable gas inlet may be provided with a connector or coupling outside of the body to which a flexible conduit can be coupled.

The whistle may comprise a whistle valve member disposed between the whistle inlet and outlet and moveable between at least a closed position in which breathable gas is restricted or prevented from flowing between the whistle inlet and outlet and an open position in which breathable gas is permitted to flow between the whistle inlet and outlet. The whistle valve member may be a piston or the like. The whistle outlet may be adjacent a labium or windcutter.

The whistle may be configured such that in use the whistle valve member is in the closed position when the pressure of the breathable gas in the breathable gas inlet is greater than a threshold and is in an open position when the pressure of the breathable gas in the breathable gas inlet is less than a threshold.

The whistle valve may be resiliently biased to an open position. The whistle may comprise a spring which resiliently biases the whistle valve member to an open position. When the pressure of the breathable gas in the breathable gas inlet is greater than a threshold it may overcome the bias of the whistle valve member to maintain it in the closed position. When the pressure of the breathable gas in the breathable gas inlet is greater than a threshold it may overcome the bias of the whistle valve member to move it to the closed position.

The threshold above which the whistle valve member moves to the closed position may be substantially the same as the threshold below which the whistle valve member moves to the open position. However, it should be appreciated that these thresholds may slightly differ from one another. For example, these thresholds may differ owing to mechanical hysteresis of the spring.

The whistle may be configured to restrict the flow of breathable gas through the whistle to no more than 10, no more than 8, no more than 6, no more than 4 or no more than 2 liters per minute.

The lung demand valve may further comprise a manifold disposed within the body and having at least three ports, wherein each port is fluidically connected to one of the valve inlet, breathable gas inlet and whistle inlet.

The threshold at which breathable gas flows from the breathable gas inlet through the whistle inlet and outlet may be between 1 and 10 bar, between 1.5 and 8 bar, between 2 and 6 bar, or between 2.5 and 5 bar.

The whistle may be detachably attached to the body. The whistle may extend from the side of the body.

There is also provided breathing apparatus comprising a lung demand valve in accordance with any statement herein.

According to another aspect of the invention there is provided a method of upgrading a lung demand valve comprising attaching a whistle to a lung demand valve to provide a lung demand valve in accordance with any statement herein.

The method may further comprise removing a component from a port which is fluidically connected to the breathable gas inlet inside the body and installing the whistle within the said port.

The invention may comprise any combination of the features and/or limitations referred to herein, except combinations of such features as are mutually exclusive.

FIG. 1 shows a lung demand valve (LDV) 10 connected to a breathing apparatus facemask 12. The LDV 10 comprises a gas inlet connector 16 which is connected to a flexible conduit 14 for supplying breathable gas. The LDV 10 also comprises a plug-in connector (not shown) which physically and fluidically attaches the LDV 10 to the facemask 12, and a whistle 18 which extends from one side of the LDV 10.

In use, the flexible conduit 14 supplies pressurised breathable gas from a source of breathable gas, such as a gas cylinder or a remote gas bank, to the LDV 10 which controls the delivery of breathable gas to the user in response to the exhalation or inhalation of the user. If the pressure of the source of breathable gas drops below a threshold, the whistle 18 sounds close to the user's ear alerting the user that the source of breathable gas is running out.

Figure 2:
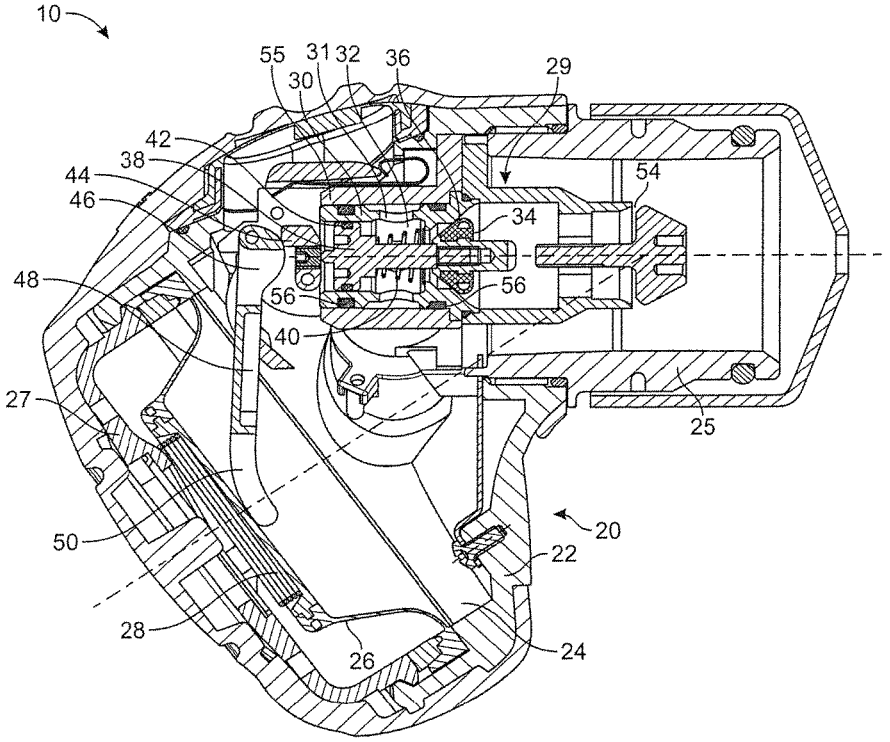
FIG. 2 schematically shows a cross-sectional view through the lung demand valve of FIG. 1.

FIG. 2 schematically shows the LDV 10 disconnected from the facemask 12. The LDV comprises a body 20 including a main housing 22 defining an internal chamber 24, and a plug-in connector 25 which is attached to the housing 22 and is in fluid communication with the internal chamber 24.

A substantially circular diaphragm 26 is retained within the housing 22 by a cap 27 that is attached to the housing 22. A spring 28 is disposed between the cap 28 and the ambient side of the diaphragm 26 and therefore acts on the diaphragm 26. The diaphragm 26 is sealed within the housing 22 such that there is no gas flow from the internal chamber 24 across the diaphragm 26. The cap 27 is provided with a number of openings which allow ambient atmosphere to both come into contact with, and act on, the diaphragm 26. The diaphragm 26 is therefore arranged to move in response to pressure changes in the internal chamber 24, such as pressure changes corresponding to the inhalation or exhalation of a user.

A valve assembly 29 is disposed within the housing 22, and in this embodiment comprises a valve housing 30 defining a valve chamber 32 and a valve inlet 31 which extends through the housing 30 into the valve chamber 32. The valve assembly 29 also comprises a valve member 34 which cooperates with a valve seat 36 to open and close the valve. The valve member 34 is attached to an actuation shaft 38 and a spring 40 acts on the shaft 38 so as to bias the valve member 34 to a closed position. The shaft 38 is sealed within the valve chamber 32 with an O-ring 42. This allows the actuation shaft 38 to axially move within the valve chamber 32 to open and close the valve, whilst sealing the valve chamber 32 to prevent undesirable gas leakage. A cam follower 44 is attached to the end of the shaft 38 and cooperates with a cam 46 that is provided on the end of a pivotable lever arm 48. The distal end 50 of the lever arm 48 cooperates with the diaphragm 26 to open and close the valve in response to the inhalation or exhalation of a user. The valve assembly 29 further comprises a breathable gas outlet 54 which is arranged to discharge breathable gas into the region of the plug-in connector 25 such that it can be breathed by a user.

The valve inlet 31 is fluidically connected to the gas inlet connector 16 through a manifold 55 disposed within the internal chamber 24.

Figure 3:
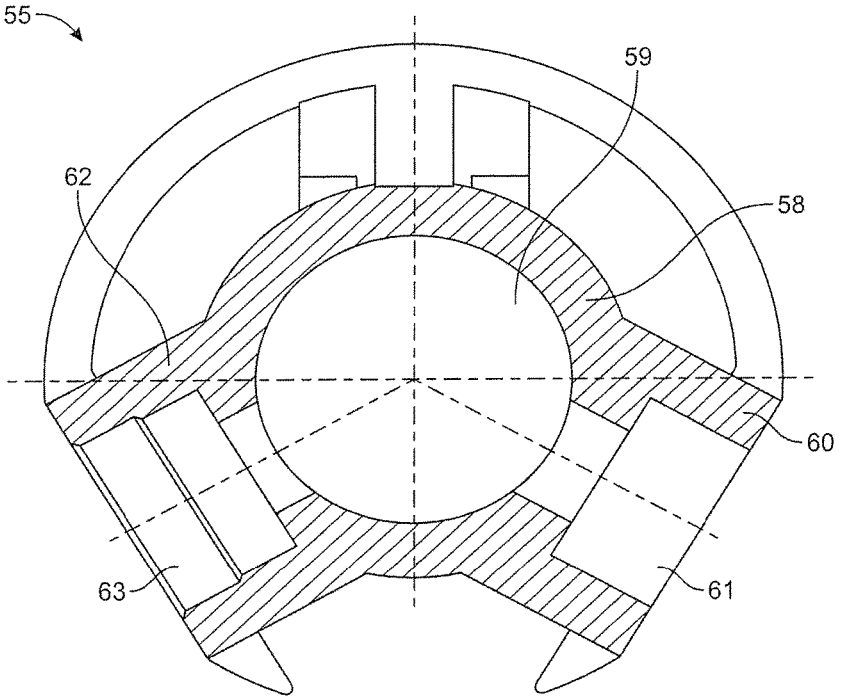
FIG. 3 schematically shows a cross-sectional view through the manifold of FIG. 1.

As shown in FIG. 3, the manifold 55 is a three-way manifold comprising three generally cylindrical tubes 58, 60, 62 that are all in fluid communication with one another. The first (or central) tube 58 has a longitudinal axis and the manifold 55 is generally symmetrical about a plane within which this axis lies. The second and third tubes 60, 62 extend from either side of the central tube 58 and open into it. The first, second and third tubes 58, 60, 62 define first, second and third gas ports 59, 61, 63 respectively which are all in fluid communication with one another. As best seen in FIG. 2, the valve assembly 29 is partially disposed within the central tube 58 with the breathable gas outlet 54 extending from one side of the tube 58 and the cam follower 44, cam 46 and lever arm 48 extending from the other side. The valve assembly 29 is sealed within the central tube 58 either side of the valve inlet 31 with two O-rings 56. These O-rings 56 are also longitudinally either side of both the second and third gas ports 61, 63 so that the second and third gas ports 61, 63 are in fluid communication with the valve inlet 31, but sealed from the internal chamber 24. The valve inlet 31 is in fluid communication with the first port 59 by virtue of being disposed within it.

Figure 4:
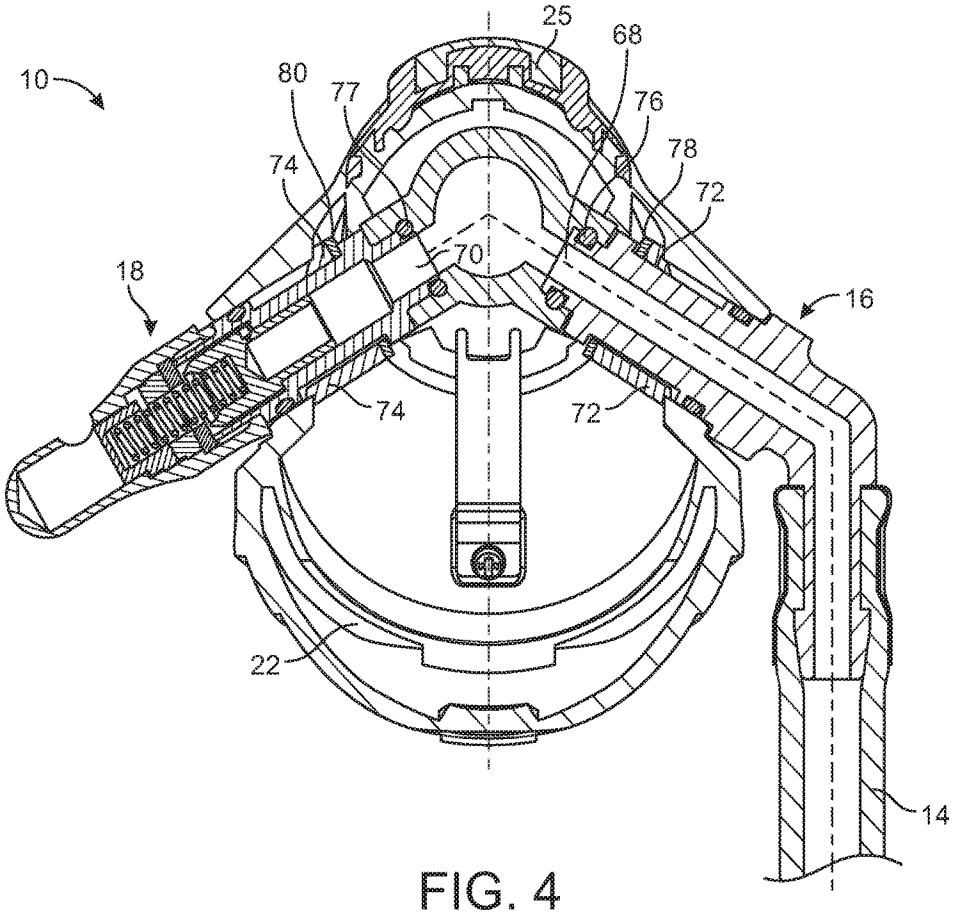
FIG. 4 schematically shows a further cross-sectional view through the lung demand valve of FIG. 1.
Figure 5:
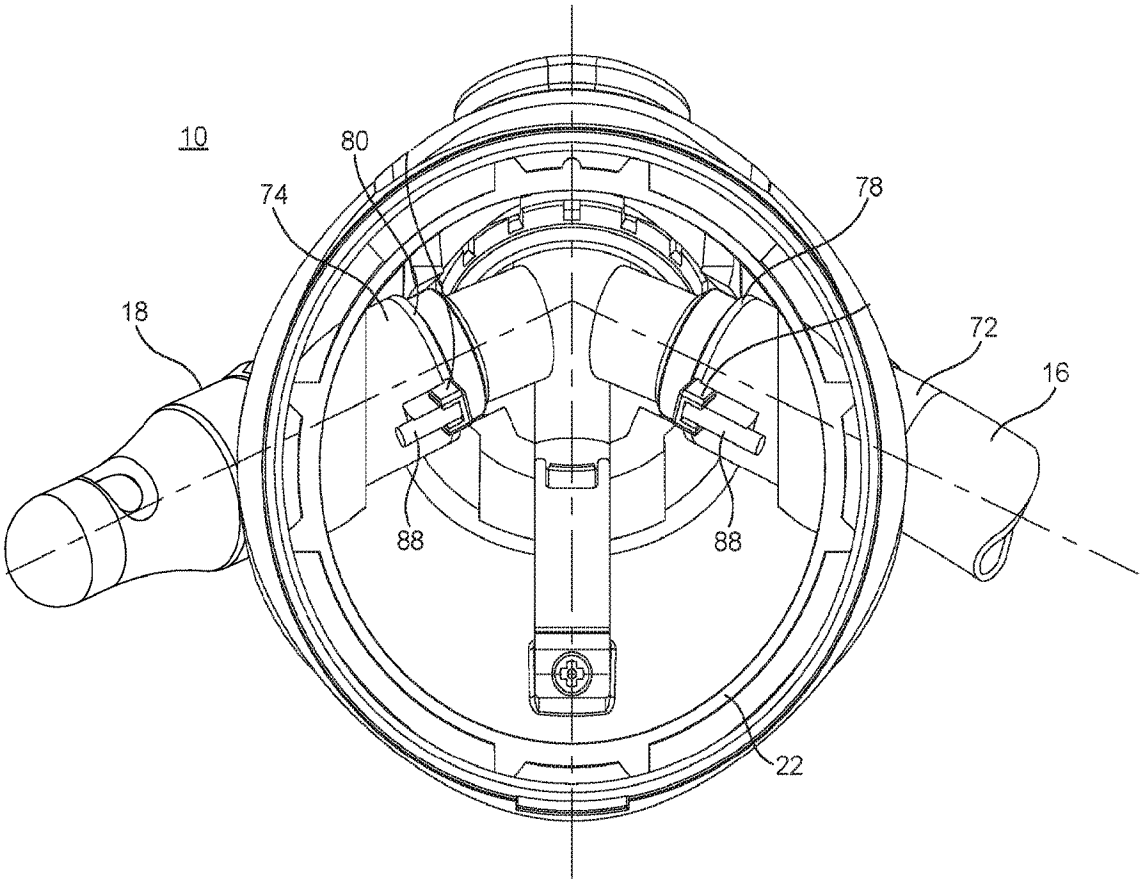
FIG. 5 schematically shows a cut-away view through the lung demand valve of FIG. 1.

As best shown in FIGS. 4 and 5, the gas inlet connector 16 extends from the outside to the inside of the housing 22 through a first sleeve 72 formed as part of the housing 22. The gas inlet 68 of the connector 16 is disposed within the second tube 60 such that it is in fluid communication with the second port 61 and is sealed therein with an O-ring 76. The whistle 18 extends from the inside to the outside of the housing 22 through a second sleeve 74 formed as part of the housing. A whistle inlet 70 is disposed within the third tube 62 such that it is in fluid communication with the third port 63 and is sealed therein with an O-ring 77. The gas inlet connector 16 and whistle 18 are held in place by snap-fit clips 78, 80. Due to the above described arrangement, the valve inlet 31, breathable gas inlet 68 and whistle inlet 70 are in direct fluid communication with one another inside the housing 22 upstream of the valve so they are all at substantially the same pressure. As will be described in detail below, in use, this pressure will be substantially the same as the supply pressure of the source of breathable gas.

Figure 6:
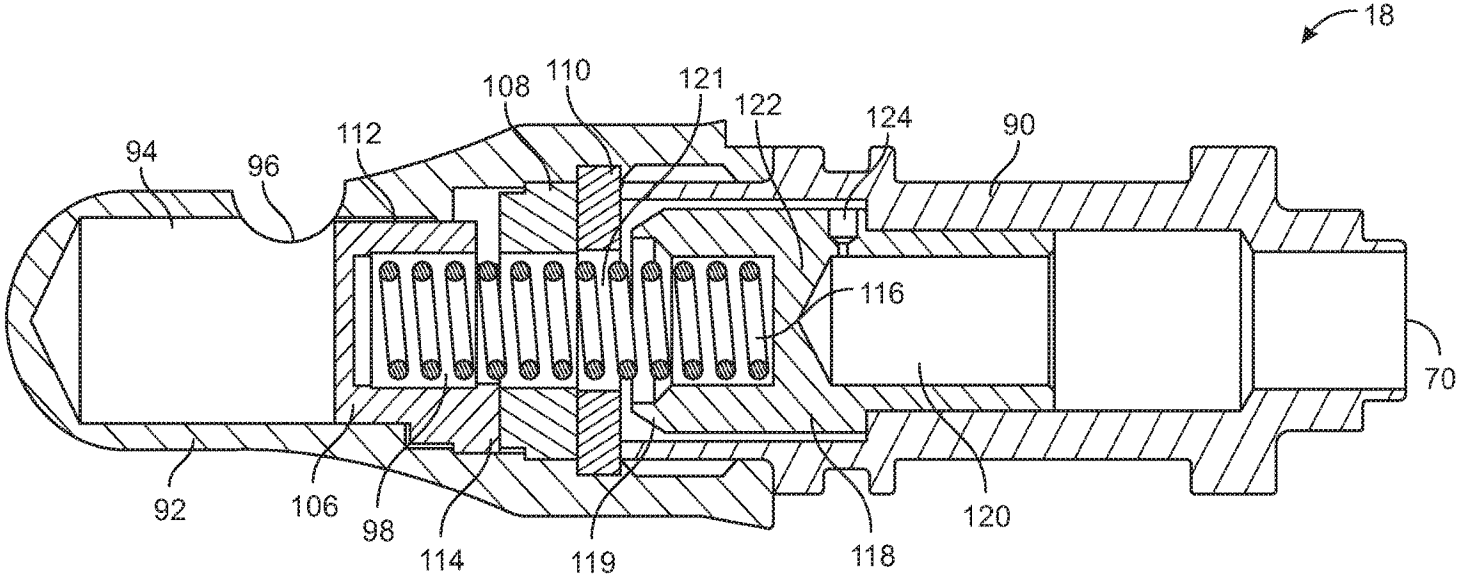
FIG. 6 shows a cross-sectional view through the whistle of FIG. 1.

As shown in FIG. 6, the whistle 18 comprises a hollow whistle body 90 and a hollow whistle cap 92 which are threaded together thereby defining a whistle chamber 94. The proximal end of the whistle 18 is provided with an axially extending whistle inlet 70 which opens into the whistle chamber 94 and the distal end of the whistle 18 is provided with a radially extending whistle outlet 96 which also opens into the whistle chamber 94. Within the whistle chamber 94 and between the whistle inlet 70 and outlet 96 is disposed a whistle valve assembly comprising a whistle flute 106, a spacer 108, a whistle seat 110, a plunger 118 having a whistle valve member 119 and a spring 116. As will be described in detail below, in use the whistle valve assembly opens and closes in response to the supply pressure of the breathable gas, causing the whistle to sound when open.

The whistle flute 106 is axially fixed upstream and adjacent to the whistle outlet 96, which forms a labium or windcutter. This whistle flute 106 is provided with a narrow longitudinally extending channel 112 having an exit adjacent to the whistle outlet 96, and also has a central bore 98. At its proximal end, the whistle flute 106 has a projection 114 against which the spacer 108 having a central opening abuts. The spacing between the flute 106 and spacer 108 provides a flow passageway between the spacer 108 and flute.

The whistle seat 110 abuts the spacer 108 and is also provided with a central opening. The whistle seat 110 is formed from an elastomeric material, such as rubber or an elastomeric polymer, so as to provide a flexible and reliable sealing surface.

The threaded assembly of the whistle body 90 and whistle cap 92 clamp the whistle flute 106, spacer 108 and the whistle seat 110 in place such that all three components are axially fixed.

The plunger 118 is slideably disposed within the whistle body 90. The distal end of the plunger 118 forms a valve member 119 and the plunger 118 is moveable between an open position (FIG. 4) in which gas can flow from the whistle inlet 70 to the whistle outlet 96 through the whistle valve assembly and a closed position (not shown) in which the whistle valve member 119 is seated against the whistle valve seat 110, thereby preventing gas flow between the whistle inlet 70 and outlet 96. The plunger 118 is generally cylindrical and has proximal and distal central bores 120, 121 in opposing ends which are separated by a piston partition 122. A radially extending opening 124 extends through the plunger 118 into the proximal bore 120.

The spring 116 is disposed within the whistle chamber 96 and extends through the central openings in the spacer 108 and seat 110. The ends of the spring 116 are located in the central bore 98 formed in the whistle flute 106 and the distal bore 121 in the plunger 118. The spring 116 acts to bias the plunger 118 towards an open position (FIG. 4) in which the whistle valve member 119 is spaced away from the whistle valve seat 110.

In use, the LDV 10 is attached to the breathing apparatus facemask 12 (FIG. 1) using the plug-in connector and a source of breathable gas is connected to the gas inlet connector 16 via the flexible conduit 14. The source of breathable gas may be a cylinder of breathable gas (either a static tank or one carried by the user), a compressor, or a ring main installed within a factory. If a cylinder of breathable gas is used, the starting (or full) supply pressure may be 300 bar and it may be desire to warn the user when the supply pressure drops to below 2.5 bar. For a ring main, it may also be desirable to warn the user when the supply pressure drops to below 2.5 bar, for example.

As the user inhales and exhales, the diaphragm 26 moves causing the valve assembly 29 to open and close which controls the flow of breathable gas to the user. In use, the gas pressure at the whistle inlet 70 will be the same as the supply pressure of the breathable gas at the gas inlet 68. The supply gas pressure acts on the piston partition 122 and acts against the spring force of the spring 116 moving the plunger 118 towards the closed position in which the valve member 119 is seated against the whistle valve seat 110. The spring force of the spring 116 is set such that when the gas pressure is above a threshold minimum pressure, 2.5 bar for example, the gas pressure maintains the plunger 118 in the closed position in which the valve member 119 is seated against the whistle valve seat 110. In the closed position, gas flow is prevented from flowing through the whistle inlet 70 and outlet 96 and therefore the whistle 18 does not sound.

Over time, the source of breathable gas may diminish and therefore the supply pressure of the breathable gas supplied at the breathable gas inlet 68 may gradually reduce. When the supply pressure of the breathable gas at the breathable gas inlet 68 falls below the threshold minimum pressure, for example 2.5 bar, the pressure acting on the piston partition 122 is no longer sufficient to counteract the spring force and maintain the plunger 118 in the closed position. Therefore, the plunger 118 moves away from the closed position to an open position (FIG. 4) in which the valve member 119 is spaced from the valve seat 110. In this position, the flow path through the whistle 18 between the inlet 70 and outlet 96 is open and breathable gas from the breathable gas inlet 68 flows through the manifold 55 and through the whistle 18 causing the whistle to sound. The whistle 18 sounds continuously irrespective of whether the user is exhaling, inhaling or at rest. The whistle 18 continues to sound until such time that the source of breathable gas is exhausted or until the pressure of the breathable gas rises above the threshold to move the plunger 118 to the closed position.

Since the whistle 18 is directly mounted to the LDV 10, it is near to the user's ear and so the user is alerted that their gas supply is nearing depletion when it sounds. This alert may cause the user to prepare for and begin evacuating the operating environment, request additional supply pressure or switch to an alternative supply of breathable gas.

The whistle 18 is configured to limit the flow rate through the whistle 18, so as to preserve breathable gas for inhalation by the user when the whistle 18 sounds. In particular, the radial opening 124 and the whistle channel 112 may be designed so as to permit a suitable flow rate.

The invention also relates to a method of upgrading a LDV by installing a whistle 18 in an LDV. In one example, an existing LDV is provided which differs from the LDV described above in that a by-pass valve is connected to the third gas port 63 in place of a whistle 18. The by-pass valve can be removed by removing the associated clip 80 and withdrawing the by-pass valve from the sleeve 74. A whistle 18, such as that described above, can then be inserted through the sleeve 74 such that the whistle inlet 70 is fluidically coupled to the third gas port 63. The clip 80 can then be placed around the whistle body 90 to retain the whistle 18 in place.

Workers operating in dirty environments, for example, chemical or oil tanks that require cleaning, use breathing apparatus to supply them with breathable gas. In such contaminated environments, the workers typically wear protective clothing over their entire body. The protective clothing and equipment worn by the workers can become extremely dirty and contaminated. Directly mounting the whistle on the LDV has the advantage that the degree to which it becomes dirty and contaminated in use is reduced, partly because of the elevated position of the whistle, and partly due to the user's natural tendency to adjust their position such that visible contaminants do not come into contact with their face, or in this case, their facemask and LDV. The whistle cap 92 may be detached from the whistle body 90 in order to clean the components of the whistle without dismantling the LDV 10

Although an embodiment of the invention has been described in which the valve assembly including the valve inlet is disposed within the manifold, it will be appreciated that in other embodiments the valve inlet may be connected to a manifold which is separated from the valve assembly, or alternatively may be directly fluidically connected to the breathable gas inlet via a fluid line. Similarly, it will be appreciated that the whistle inlet need not be connected to the breathable gas inlet by a manifold, but may be directly fluidically connected to the breathable gas inlet by a fluid line.

Although the invention has been described in terms of exemplary embodiments, it is not limited thereto. Rather, the appended claims should be construed broadly to include other variants and embodiments of the invention which may be made by those skilled in the art without departing from the scope and range of equivalents of the invention. This disclosure is intended to cover any adaptations or variations of the embodiments discussed herein.

The invention claimed is:

1. A lung demand valve, comprising:

a body within which is disposed a diaphragm and a valve assembly having a valve inlet, the valve assembly and diaphragm arranged to cooperate to control the delivery of breathable gas to a user, one side of the diaphragm being exposed to ambient pressure;

a breathable gas inlet fluidically connected to the valve inlet inside the body and arranged to be fluidically connected to a supply of breathable gas;

a whistle coupled to the body and extending from the inside to the outside of the body, the whistle having a whistle inlet disposed within the body and fluidically connected to the breathable gas inlet inside the body, and a whistle outlet disposed outside the body; and a manifold disposed within the body and having at least three ports, wherein each port is fluidically connected to one of the valve inlet, breathable gas inlet and whistle inlet, wherein in use, when the pressure of the breathable gas in the breathable gas inlet is less than a threshold, breathable gas flows from the breathable gas inlet through the whistle inlet and outlet, thereby causing the whistle to sound outside of the body.

2. A lung demand valve, comprising:

a body within which is disposed a diaphragm and a valve assembly having a valve inlet, the valve assembly and diaphragm arranged to cooperate to control the delivery of breathable gas to a user, one side of the diaphragm being exposed to ambient pressure;

a breathable gas inlet fluidically connected to the valve inlet inside the body and arranged to be fluidically connected to a supply of breathable gas; and a whistle coupled to the body and having a whistle inlet fluidically connected to the breathable gas inlet inside the body and a whistle outlet disposed outside the body;

wherein in use, when the pressure of the breathable gas in the breathable gas inlet is less than a threshold, breathable gas flows from the breathable gas inlet through the whistle inlet and outlet, thereby causing the whistle to sound outside of the body.

3. A lung demand valve according to claim 2, wherein the whistle extends from the inside to the outside of the body.

4. A lung demand valve according to claim 2, wherein the whistle inlet is directly fluidically connected to the breathable gas inlet upstream of the valve inlet.

5. A lung demand valve according to claim 2, wherein the whistle inlet is disposed within the body.

6. A lung demand vale according to claim 2, wherein the breathable gas inlet extends from the outside to the inside of the body.

7. A lung demand valve according to claim 2, wherein the whistle comprises a whistle valve member disposed between the whistle inlet and outlet and moveable between at least a closed position in which breathable gas is restricted from flowing between the whistle inlet and outlet and an open position in which breathable gas is permitted to flow between the whistle inlet and outlet.

8. A lung demand valve according to claim 7, wherein the whistle is configured such that in use the whistle valve member is in the closed position when the pressure of the breathable gas in the breathable gas inlet is greater than a threshold and is in an open position when the pressure of the breathable gas in the breathable gas inlet is less than a threshold.

9. A lung demand valve according to claim 7, wherein the whistle valve member is resiliently biased to an open position.

10. A lung demand valve according to claim 9, wherein the whistle comprises a spring which resiliently biases the whistle valve member to an open position.

11. A lung demand valve according to claim 9, wherein when the pressure of breathable gas in the breathable gas inlet is greater than a threshold it overcomes the bias of the whistle valve member to maintain it in the closed position.

12. A lung demand valve according to claim 2, wherein the whistle is configured to restrict the flow of breathable gas through the whistle to no more than 5 liters per minute.

13. A lung demand valve according to claim 2, further comprising a manifold disposed within the body and having at least three ports, wherein each port is fluidically connected to one of the valve inlet, breathable gas inlet and whistle inlet.

14. A lung demand valve according to claim 2, wherein the threshold at which breathable gas flows from the breathable gas inlet through the whistle inlet and outlet is between 1.5 and 6 bar.

15. A lung demand valve according to claim 2, wherein the whistle is detachably attached to the body.

16. A lung demand valve according to claim 2, wherein the whistle extends from the side of the body.

17. A breathing apparatus comprising a lung demand valve in accordance with claim 2.

18. A method of upgrading a lung demand valve comprising attaching a whistle to a lung demand valve to provide a lung demand valve in accordance with claim 2.

19. A method according to claim 18, comprising removing a component from a port which is fluidically connected to the breathable gas inlet inside the body and installing the whistle within the said port.

* * * * *